US012736267B2

(12) United States Patent
Kadosh et al.

(10) Patent No.: US 12,736,267 B2
(45) Date of Patent: Sep. 15, 2026

(54) ICE BUCKET WITH STOPPERS FOR PLACING BOTTLES IN DIFFERENT POSITIONS

(71) Applicant: Mogogo Ltd, Tel Aviv (IL)

(72) Inventors: Yariv Kadosh, Tel Aviv (IL); Mordehay Ben Aharon, Tel Aviv (IL); Amit Kaufman, Borgata (IL)

( * ) Notice: Subject to any disclaimer, the term of this patent is extended or adjusted under 35 U.S.C. 154(b) by 141 days.

(21) Appl. No.: 18/798,046

(22) Filed: Aug. 8, 2024

(65) Prior Publication Data

US 2026/0043594 A1 Feb. 12, 2026

(51) Int. Cl.
*F25D 3/08* (2006.01)
*A47G 23/02* (2006.01)

(52) U.S. Cl.
CPC ..... *F25D 3/08* (2013.01); *A47G 23/0241* (2013.01); *F25D 2303/081* (2013.01)

(58) Field of Classification Search
CPC ... F25D 3/08; F25D 3/06; F25D 3/045; F25D 3/04; F25D 3/02; F25D 2300/00; F25D 2303/08; F25D 2303/081; F25D 2303/084; F25D 2303/0841; F25D 2303/0843; F25D 2303/0845; F25D 31/002; F25D 31/006; F25D 31/007; A47G 23/02; A47G 23/0241
See application file for complete search history.

(56) References Cited

U.S. PATENT DOCUMENTS

2005/0092759 A1* 5/2005 Willat ..... A47G 19/23 220/703
2011/0252824 A1* 10/2011 Dallas ..... F25D 3/08 206/518
2020/0047949 A1* 2/2020 Lin ..... B65D 25/32

* cited by examiner

*Primary Examiner* — Miguel A Diaz

(57) ABSTRACT

A bucket for chilling bottles that includes a vessel and right, left and central stoppers that form part of the vessel's bottom. The right stopper is located between the center of the vessel and the right side of the vessel, the left stopper is located between the center of the vessel and the left side of the vessel, and the central stopper is located in the center of the vessel. The vessel can receive a bottle in a first position when the bottle is placed between the left stopper and the left side wall of the vessel, in a second position when the bottle is placed on the left stopper, in a third position when the bottle is placed on the right stopper, and in a fourth position when the bottle is placed on the central stopper.

2 Claims, 4 Drawing Sheets

ICE BUCKET WITH STOPPERS FOR PLACING BOTTLES IN DIFFERENT POSITIONS

TECHNICAL FIELD

The present invention refers to an ice bucket for chilling champagne and wine that includes right, left and central stoppers for placing the bottles in a first, second, third and fourth positions.

BACKGROUND ART

The use of ice buckets to chill champagne and wine bottles is very common. The user's goal is that on the one hand the bottle protrudes slightly from the rim of the bucket, to give an aesthetic tone to the event and also so that the bottle can be taken from the bucket to pour the drink from it into the glasses, and also so that a larger part of the bottle is submerged in the ice water in the bucket to provide a cooling effect as large as possible. The use of the ice buckets that exist today entails two main problems: once there is a given bucket and a bottle is placed in it, it is not possible to control how much the bottle will stick out of the bucket, and consequently how much the bottle will be submerged in the ice water in the bucket. The second problem, when there are several bottles, in a bucket, then they are stiff one by one, and slide against each other, something that undermines the prestigious status that the users try to equate to the event. The ice bucket that is the subject of the present invention presents a good solution to these and other problems.

DESCRIPTION OF THE DRAWINGS

The intention of the drawings attached to the application is not to limit the scope of the invention and its application. The drawings are intended only to illustrate the invention and they constitute only one of its many possible implementations.

THE INVENTION

Figure 1:
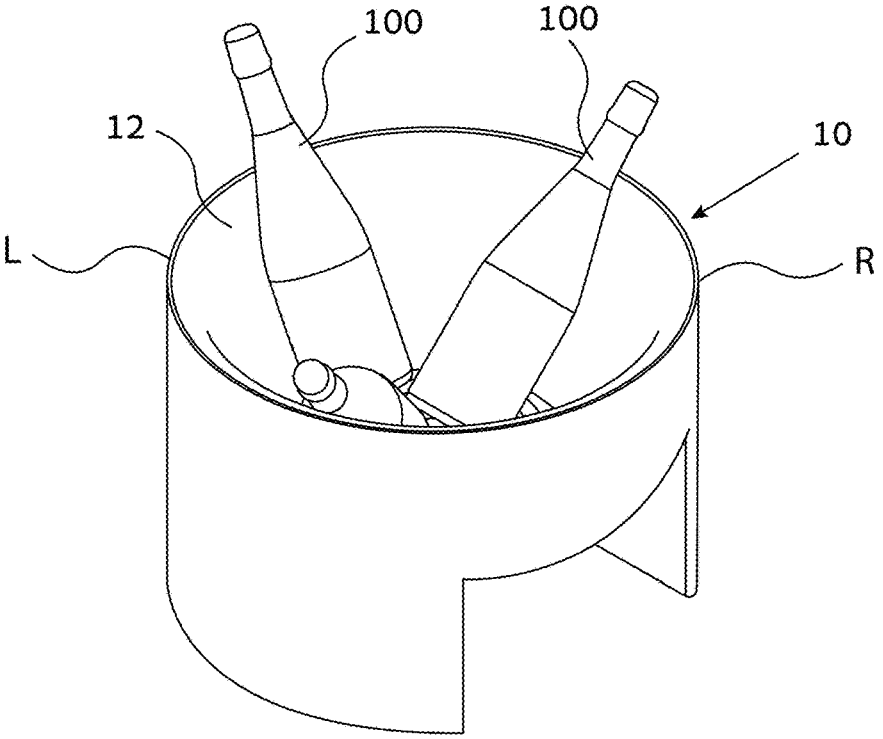
FIG. 1 depicts the ice bucket (10) with a few bottles (100).

The main object of the present invention is to provide a bucket (10) for chilling a bottle (100) of drinks such as champagne or wine with cubes of ice or ice-water mixture (200), or a plurality of bottles. The ice bucket (10) comprises (a) a vessel (11) that comprises a substantially upright peripheral rounded wall (12), a bottom (13) and a rounded upper opening (14), and (b) a right stopper (15R) and a left stopper (15L) that form a part of the bottom of the vessel. The bucket can be circular, elliptical, to one degree or another, and can also include straight sections. The bucket includes the stoppers as described above. It is possible to have one circular stopper, even a complete circle is possible, and in such case one side of it will be considered the right stopper and the opposite side will be considered the left stopper. The use of the expressions right and left in this disclosure and in the claims is intended to indicate opposite directions, one opposite the other, and rather the right or left side of the user or of another body.

The term stoppers in this disclosure and in the claims means a protrusion or something protruding, such as lugs or pins, and the like, from the bottom of the bucket, on which or on the sides of which the bottom of the bottle can be stopped and the bottle can rest and lean stably on the peripheral rim of the bucket. In the drawings, the stoppers are depicted in the form of a circular ring bump.

The right stopper is positioned between the center (16) of the vessel and the right side (R) of the vessel, and the left stopper is positioned between the center of the vessel and the left side (L) of the vessel.

The vessel is capable to contain cubes of ice or ice-water mixture and is designed to receive the bottle that is placed in the vessel in a first position, a second position, or a third position.

In the first position, the bottom (101) of the bottle rests (stopped) between the left stopper and the peripheral wall on the left side of the vessel, and the bottle leans on the right side of the vessel and stands at a first angle (a). In this first position, the bottle is more immersed in the cavity of the bucket (within the ice water) and it protrudes but slightly outside the rim of the bucket.

In the second position, the bottom of the bottle rests (stopped) on the left stopper, and the bottle leans on the right side of the vessel and stands at a second angle (b). The second angle is greater than the first angle. In this second position, the bottle is less immersed in the cavity of the bucket (within the ice water) and less protrudes outside the rim of the bucket, in relation to the first position.

In the third position, the bottom of the bottle rests (stopped) on the right stopper, and the bottle leans on the right side of the vessel and stands at a third angle (c). The third angle is greater than the second angle. In this third position, the bottle is less immersed in the ice water and maximally protrudes outside the rim of the bucket, in relation to the first and the second position, and it is much closed to stand vertically.

And of course, everything described above can be in the opposite direction. The special structure of the bucket, and the stoppers, enable the user to place the bottle inside the bucket in several positions, at several angles. Also, if the user places several bottles in the bucket, each of which is supported at its bottom in a different position on the stoppers, then the fear that they will rattle each other every time the user pull one bottle out is significantly reduced.

The bucket (10) may further include a central stopper (15C) that also form a part of the bottom of the vessel and that is located on the center of the vessel. In such embodiment, the vessel is further designed to enable the user to place the bottle in a fourth position in which the bottom of the bottle rests (stopped) on the central stopper, and the bottle leans (rest) on the right side of the vessel and stands at a fourth angle (d). The fourth angle is greater than the second angle and smaller than the third angle. In this fourth position, the bottle is a bit less vertical than in the third position.

The vessel is further designed to receive at the same time two bottles, wherein a first bottle (100A) is in the second position and the second bottle (100B) is in the third position. The vessel is further designed to receive at the same time also a third bottle (100C) in the fourth position.

Figure 2:
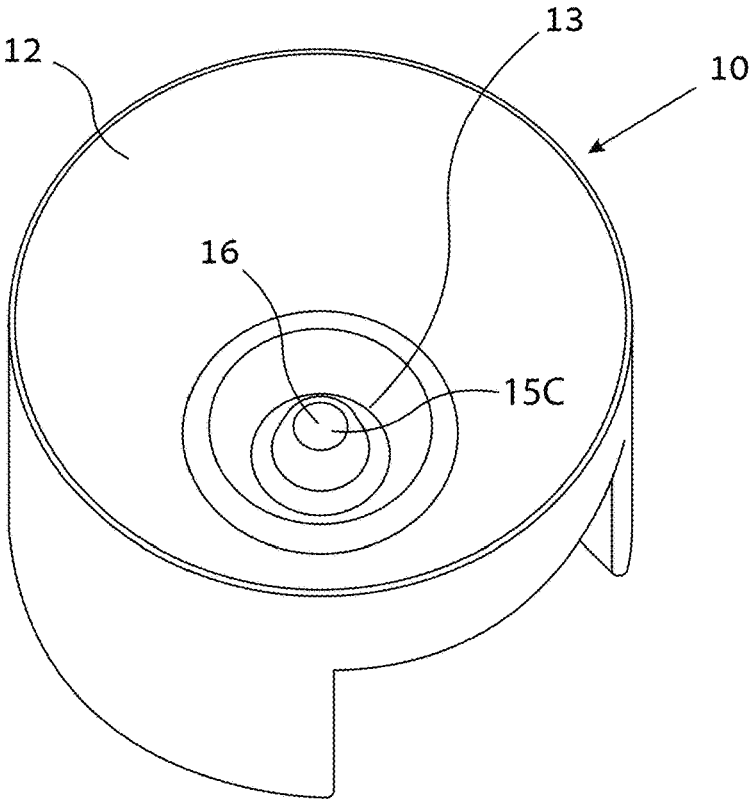
FIG. 2 is a top perspective depiction of the ice bucket (10).
Figure 3:
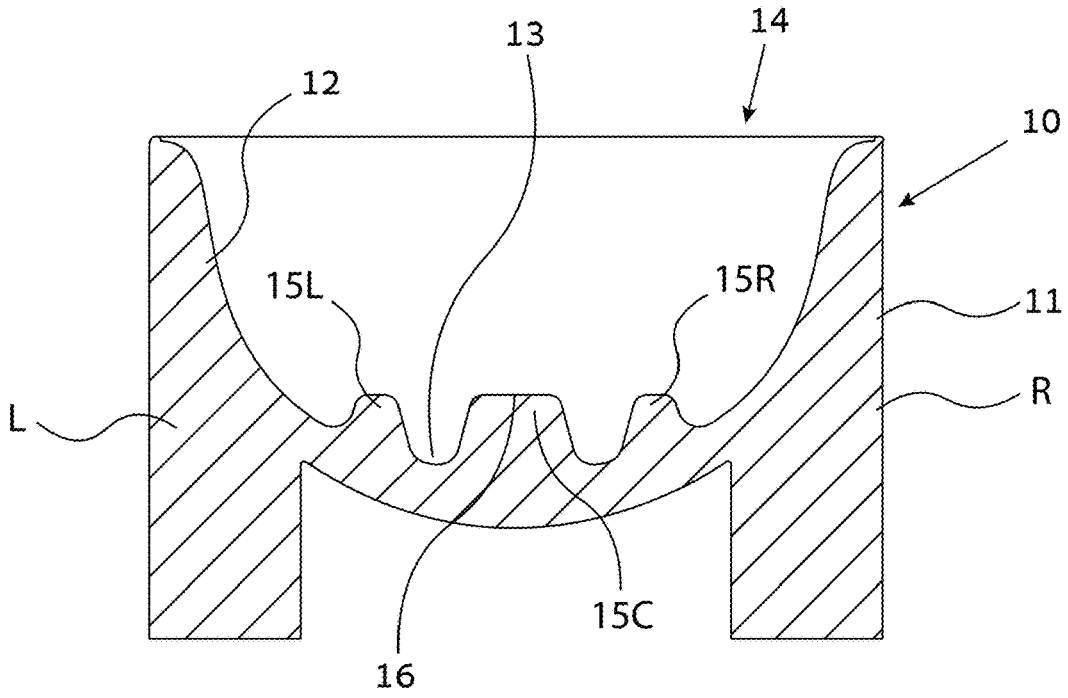
FIGS. 3 and 4 are a cross-sectional depiction of the ice bucket (10).
Figure 4:
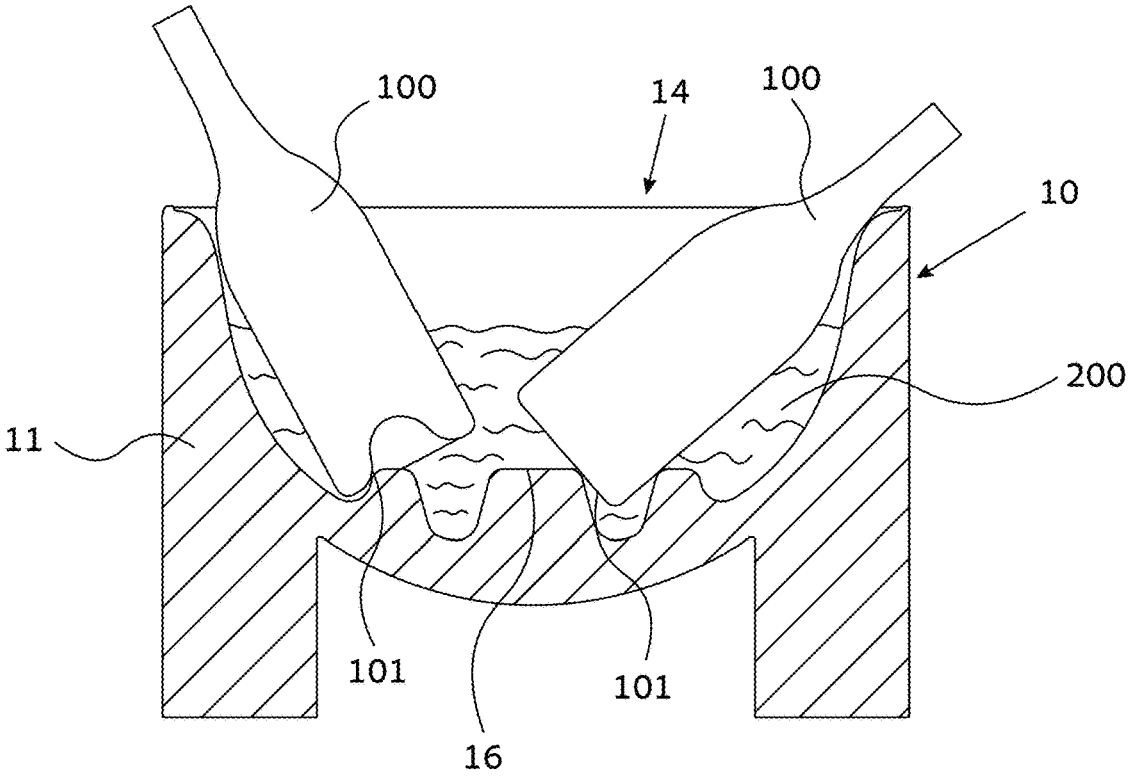
Figure 5A:
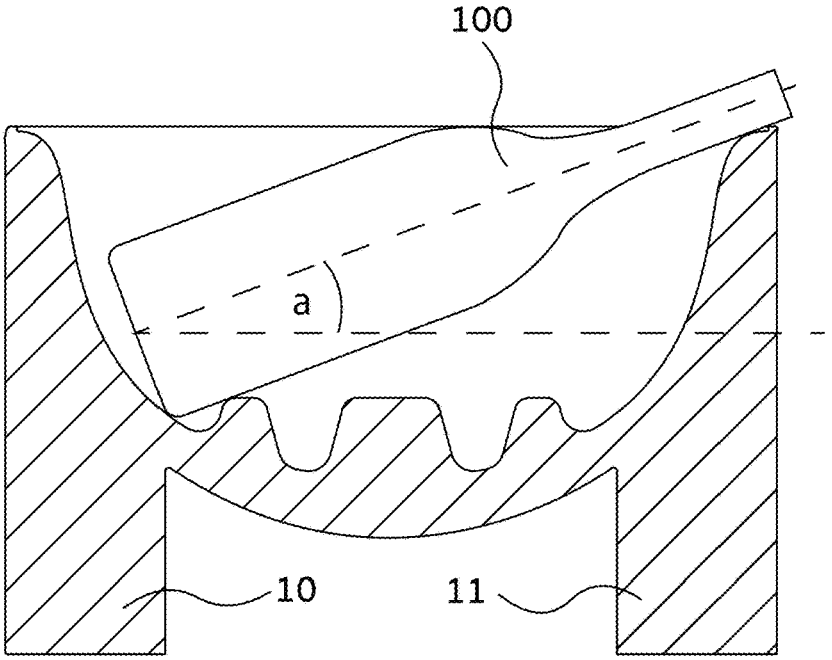
FIGS. 5A-5D depict the ice bucket (10) with a bottle (100) in the first, second, third and fourth positions respectively.
Figure 5B:
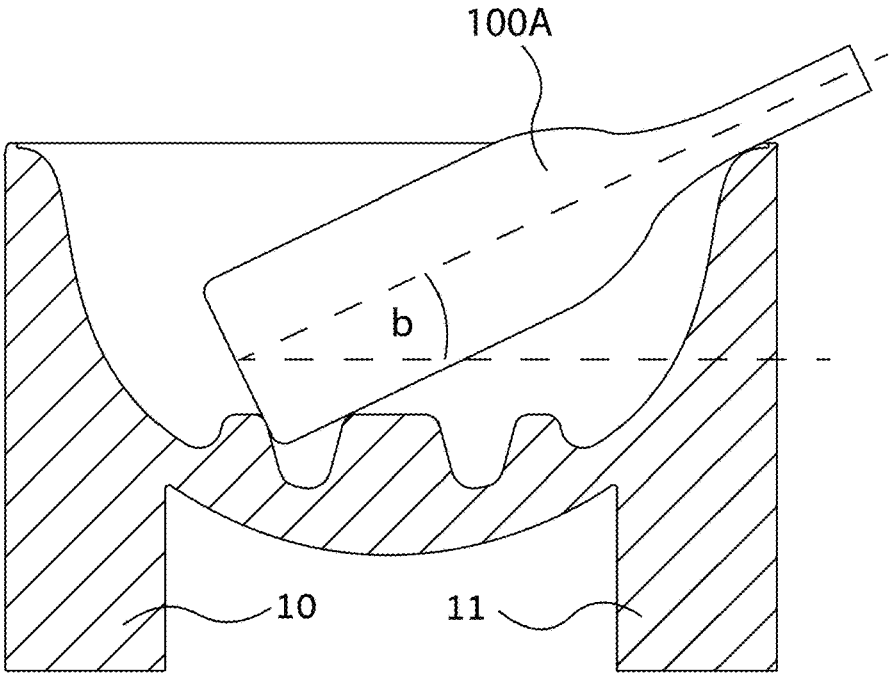
Figure 5C:
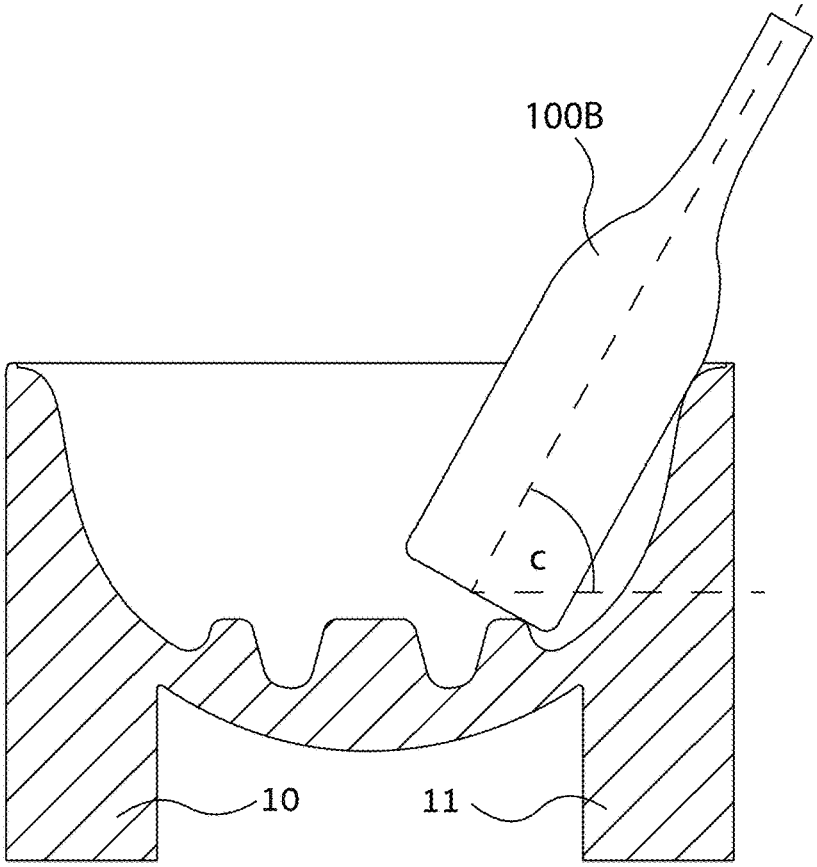
Figure 5D:
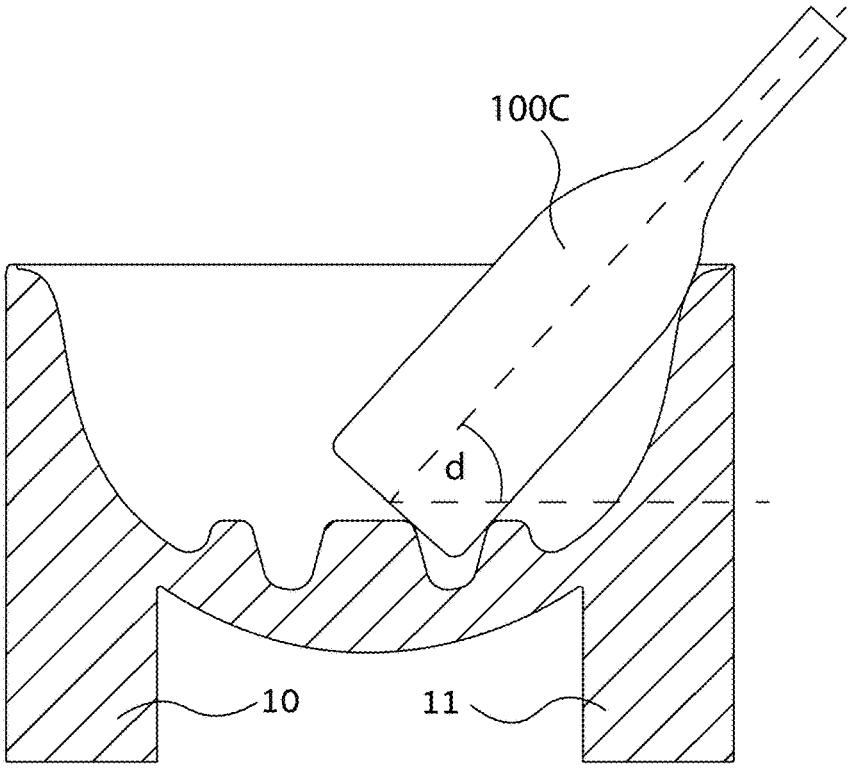

FIG. 1 depicts the ice bucket (10) with a few bottles (100), FIG. 2 is a top perspective depiction of the ice bucket (10), FIGS. 3 and 4 are a cross-sectional depiction of the ice bucket (10), and FIGS. 5A-5D depict the bucket (10) with a bottle (100) in the first, second, third and fourth positions respectively.

What is claimed is:

1. A bucket for chilling multiple bottles simultaneously with an ice-water mixture, comprising:

(a) a vessel comprising an upper opening, a substantially upright peripheral wall having a right side and a left side, and a bottom defining a floor level; and (b) a right stopper and a left stopper, each forming a part of the bottom and configured as an upwardly raised protrusion extending vertically above said floor level;

wherein the right stopper is located between a center of the bottom and the right side of the peripheral wall, and the left stopper is located between the center of the bottom and the left side of the peripheral wall;

wherein the right stopper and the right side of the peripheral wall are separated by a space exposing a portion of said bottom; wherein the left stopper and the left side of the peripheral wall are separated by a space exposing another portion of said bottom; and wherein the right stopper and the left stopper are separated from one another by a central space exposing a portion of said bottom surrounding the center of the bottom;

wherein said exposed portions of the bottom reside at a lower elevation than the raised right and left stoppers;

wherein the vessel is configured to simultaneously accommodate at least a first bottle and a second bottle resting therein at different structural angles;

wherein the vessel is configured to receive a bottle in any one of a first position, a second position, and a third position, wherein the angle of the bottle is structurally determined by which specific stopper or exposed portion of the bottom the bottle rests upon:

wherein when the bottle is in the first position, a bottom of the bottle rests on the exposed portion of the bottom between the left stopper and the left side of the peripheral wall, while the bottle leans against the right side of the peripheral wall and stands at a first angle (a);

wherein when the bottle is in the second position, the bottom of the bottle rests directly on top of the raised left stopper, while the bottle leans against the right side of the peripheral wall and stands at a second angle (b), wherein the second angle (b) is greater than the first angle (a); and wherein when the bottle is in the third position, the bottom of the bottle rests directly on top of the raised right stopper, while the bottle leans against the right side of the peripheral wall and stands at a third angle (c), wherein the third angle (c) is greater than the second angle (b);

wherein the vessel is dimensioned to receive at the same time a first bottle stable in the second position and a second bottle stable in the third position.

2. The bucket of claim 1, further comprising a central stopper forming a part of said bottom of said vessel, wherein the central stopper is configured as an upwardly raised protrusion extending vertically above said floor level and is located at the center of the bottom within said central space exposing a portion of the bottom;

wherein the vessel is further configured to receive a third bottle simultaneously in a fourth position, in which a bottom of the third bottle rests directly on top of the raised central stopper, while the third bottle leans against said right side of the peripheral wall and stands at a fourth angle (d);

wherein the fourth angle (d) is greater than said second angle (b) and smaller than said third angle (c); and wherein the vessel is configured to receive at the same time said first bottle in said second position, said second bottle in said third position, and a third bottle in the fourth position.

* * * * *